US011796148B2

(12) United States Patent
Kemetmüller et al.

(10) Patent No.: US 11,796,148 B2
(45) Date of Patent: Oct. 24, 2023

(54) LIGHTING DEVICE FOR A MOTOR VEHICLE HEADLIGHT

(71) Applicant: ZKW Group GmbH, Wieselburg (AT)

(72) Inventors: Matthias Kemetmüller, Vienna (AT); Alexander Strohmüller, Ybbs (AT)

(73) Assignee: ZKW Group GmbH, Wieselburg (AT)

( * ) Notice: Subject to any disclaimer, the term of this patent is extended or adjusted under 35 U.S.C. 154(b) by 67 days.

(21) Appl. No.: 17/639,421

(22) PCT Filed: Aug. 11, 2020

(86) PCT No.: PCT/EP2020/072517
§ 371 (c)(1),
(2) Date: Mar. 1, 2022

(87) PCT Pub. No.: WO2021/043544
PCT Pub. Date: Mar. 11, 2021

(65) Prior Publication Data

US 2022/0299182 A1 Sep. 22, 2022

(30) Foreign Application Priority Data

Sep. 6, 2019 (EP) ..... 19195885

(51) Int. Cl.
*F21S 41/143* (2018.01)
*F21S 41/275* (2018.01)
*F21S 41/20* (2018.01)

(52) U.S. Cl.
CPC ..... *F21S 41/143* (2018.01); *F21S 41/275* (2018.01); *F21S 41/285* (2018.01)

(58) Field of Classification Search
CPC ..... F21S 41/143; F21S 41/275; F21S 41/285; F21S 41/25; F21S 41/27
See application file for complete search history.

(56) References Cited

U.S. PATENT DOCUMENTS 4,733,335 A 3/1988 Serizawa et al.
6,264,347 B1 7/2001 Godbillon et al.
(Continued)

FOREIGN PATENT DOCUMENTS

CH 296715 A 2/1954
DE 1259747 B 1/1968
JP 2017112065 A 6/2017

OTHER PUBLICATIONS

International Search Report for PCT/EP2020/072517, dated Oct. 14, 2020 (14 pages).
(Continued)

*Primary Examiner* — Matthew J. Peerce
(74) *Attorney, Agent, or Firm* — Eversheds Sutherland (US) LLP

(57) ABSTRACT

The invention relates to a lighting device (1) for a motor vehicle headlight, comprising:

a light module (2), wherein the light module (2) comprises a light source (2*a*) and a collimator (3), which is set up in such a manner that the light generated by the light source (2*a*) is emitted via a light-emitting surface (3*a*) in a light propagation direction (4), an optical element (5) having a light-coupling surface (5*a*) and a light-decoupling surface (5*b*), wherein the light of the collimator is guided through the optical element (5), wherein the light-decoupling surface (5*b*) of the optical element (5) has multiple optical elements (6) through which the light is emitted as a divergent light beam, wherein the light-emitting surface (3*a*) of the collimator (3) is formed from multiple lenses (7), wherein each lens (7) is set up for emitting the light of the light source (2*a*) to the light-coupling surface (5*a*) of the optical element (5) in a divergent manner, wherein all lenses (7) have essentially the same focal length, wherein the collimator (3) and the optical (Continued)

element (5) are spaced apart from each other, wherein the distance between them essentially corresponds to the focal length of the lenses (7).

21 Claims, 3 Drawing Sheets

(56) References Cited

U.S. PATENT DOCUMENTS

| | | | | |
|---|---|---|---|---|
| 10,174,900 | B2 * | 1/2019 | Schone | F21S 41/275 |
| 10,222,019 | B1 * | 3/2019 | Li | F21S 45/47 |
| 10,894,506 | B2 * | 1/2021 | Choi | F21S 41/43 |
| 2018/0320852 | A1 | 11/2018 | Mandl | |
| 2020/0158305 | A1 * | 5/2020 | Chen | F21S 41/275 |

OTHER PUBLICATIONS

Search Report for European Patent Application No. 19195885.9 dated Feb. 28, 2020 (5 pages).

* cited by examiner

LIGHTING DEVICE FOR A MOTOR VEHICLE HEADLIGHT

The invention relates to a lighting device for a motor vehicle headlight, comprising:

at least one light module, wherein the light module comprises a light source and a collimator associated with the light source, wherein the light source generates light and couples the same into the collimator, wherein the collimator is set up in such a manner that the light generated by the light source is emitted via a light-emitting surface of the collimator as a divergent light beam in a light propagation direction, an optical element which is arranged downstream of the collimator, as seen in the light propagation direction, having a light-coupling surface and a light-decoupling surface, wherein the light which is emitted from the collimator strikes the light-coupling surface of the optical element, is directed through the optical element to the light-decoupling surface of the optical element, and is emitted from the optical element at the light-decoupling surface, wherein the light-coupling surface of the optical element has a Fresnel optics, wherein the Fresnel optics is set up for refracting the light beams as they enter the optical element in such a manner that the light beams propagate parallel to each other within the optical element, wherein the light-decoupling surface of the optical element has multiple optical elements, wherein each optical element is designed and set up such that the light is emitted from each optical element as a light beam, preferably a divergent light beam.

The invention further relates to a lighting system.

Numerous lighting devices for motor vehicle headlights are known from the prior art. Lighting devices in which light is emitted over a relatively large area do not achieve a homogeneous lighting effect, which is disadvantageous. This is due to the spatially inhomogeneous light intensity of the light sources. In previous efforts to improve the lighting effect, diffusion lenses were applied downstream of a collimator, for example. However, these have considerable weight and do not achieve the legally required light values, which are required for lighting devices used in motor vehicle headlights.

The object of the present invention is to alleviate or eliminate the disadvantages of the prior art. The goal of the invention therefore is in particular to create a lighting device in which the homogenization of the lighting effect is further improved.

This object is achieved by a lighting device having the features of claim 1. Preferred embodiments are specified in the dependent claims.

According to the invention, the light-emitting surface of the collimator is formed from multiple lenses, which are preferably arranged in a uniform grid on the entire light-emitting surface of the collimator, wherein each lens is set up for radiating the light of the light source onto the light-coupling surface of the optical element in a divergent manner, such that each of the multiple lenses illuminates the light-coupling surface of the optical element, wherein all lenses have essentially the same focal length, wherein the collimator and the optical element are spaced apart from each other, wherein the distance between them essentially corresponds to the focal length of the lenses.

This results in the advantage that the light from the light source is diffused through all lenses, which are arranged on the light-emitting surface of the collimator, onto the light-coupling surface, whereby the light-coupling surface of the optical element is illuminated particularly uniformly per unit area. In particular, the light intensity at the light-coupling surface of the optical element per unit area is essentially constant. The lenses are preferably designed as diffusion lenses and formed integrally with the collimator. The light emitted divergently by each lens strikes the light-coupling surface of the optical element and is coupled into the optical system via the Fresnel optics. Advantageously, the weight of the optical element can be reduced by the use of a Fresnel optics. Within the optical element, the light beams extend parallel to each other and are diffused at the light-decoupling surface by the optical elements as they are emitted from the optical system. This allows a particularly homogeneous lighting effect to be achieved on the light-decoupling surface. In other words, the light-decoupling surface displays a uniform brightness per unit area.

The optical element can be plate-shaped, wherein the plate-shaped optical element can be designed curved or flat. This allows for a particularly low weight to be achieved. The width of the plate, which corresponds to the expansion of the plate in the light propagation direction, can be between 5 mm and 15 mm. The length of the plate can be between 20 mm and 50 mm. The height of the plate can be between 20 mm and 50 mm.

Preferably, each of the multiple lenses illuminates the light-coupling surface of the optical element completely, which means that the illumination of the light-coupling surface is composed of an overlap of the light emitted by all lenses. Preferably, the light escaping from a single lens essentially completely overlaps with the light emitted from all other lenses on the light-coupling surface. Thus, the light intensity per unit area at the light-coupling surface of the optical element is essentially constant or of the same value, which is advantageous. In other words, the differences in intensity of the light emitted by the light source are compensated for or evened out by overlapping the light emitted by each lens.

In order to enable a particularly uniform illumination of the light-coupling surface of the optical element, each of the lenses in particular has the same dimensions and/or optical properties.

Preferably, the diameter of each lens is 0.2 mm to 5 mm, preferably 0.6 mm to 3 mm, particularly preferably 1 mm to 2 mm. Due to the small area of the respective lenses relative to the light-emitting surface of the collimator, the entire light-emitting surface can be formed from a large number of lenses. This advantageously leads to an overlapping of a large number of light beams, which in turn improves the uniform illumination of the light-coupling surface of the optical element. The collimator can be conically shaped and have an opening angle of, for example, 25° to 30°.

In particular, the light-emitting surface of the collimator is smaller than the light-coupling surface of the optical element. The overall size of the lighting device can be reduced by means of a collimator of a small size relative to the optical element.

In order to avoid distracting scattered light, which may radiate laterally past the optical element and thus impair the uniform lighting effect, the light-emitting surface of the collimator can be spaced apart and arranged relative to the light-coupling surface of the optical element in such a manner that the light emitted from each lens exclusively illuminates the light-coupling surface of the optical element completely or exactly. Preferably, the individual lenses are calculated by a person skilled in the art in such a manner that, at a distance from the lenses which corresponds to the focal length of the lenses, each lens is illuminated in an equally large area which corresponds to the light-coupling surface of the optical element.

The lighting device may have a first and a second light module, wherein preferably the first light module illuminates a first partial area of the light-coupling surface, and the second light module illuminates a second partial area of the light-coupling surface, wherein, for example, the first and the second partial area each form one half of the light-coupling surface. The first and the second light module may, for example, have light sources of different colours, which advantageously makes it possible to emit different coloured light via the light-decoupling surface of the optics system. It is also possible that the first and the second light module each illuminate the entire light-coupling surface of the optical system, preferably completely, i.e., covering its entire area. The lighting device may also comprise three or more light modules.

To achieve a uniform or homogeneous light intensity per unit area on the light-coupling surface of the optical element, in particular the first and the second partial area can be illuminated by the respective light modules without overlapping.

According to the invention, a lighting system is provided, comprising a lighting device according to the invention and a lighting unit, wherein the lighting unit is set up for generating light and radiating the same along a light-emitting direction, wherein the light-emitting direction is directed to the focal plane of the lenses of the collimator of the light module, wherein the lighting system comprises an adjusting device by means of which the optical element of the lighting device can be transposed between a first and a second position, wherein the optical element in the first position is arranged in such a manner that the light emitted by the at least one light module of the lighting device strikes the light-coupling surface of the optical element, wherein the optical element in the second position is arranged in such a manner that no light emitted by the at least one light module of the lighting device strikes the light-coupling surface of the optical element and the optical element is positioned outside the light-emitting direction of the light emitted by the lighting unit.

Due to the adjustability of the optical system, different light distributions can be generated by the lighting system depending on the position of the optical system. Advantageously, it is not necessary to adjust the entire lighting device or the lighting unit of the lighting system between two positions, but only the optical system. This means that smaller, less powerful adjusting devices, such as a linear drive or a servo motor, can be used. If, for example, the lighting system is installed in a motor vehicle, the further advantage is that less installation space must be made available for the transition between the first and the second position, as the at least one light module of the lighting device and the lighting unit can be installed in a fixed position, as only the optical system is adjustable. The optical system may, for example, be fastened to one or more guide rails in an adjustable manner. The optical element can also be pivoted about a pivot axis by means of the adjusting device, wherein the optical system in the pivoted state is positioned outside the light propagation direction of the at least one light module of the lighting device and outside the light-emitting direction of the lighting unit.

To create a particularly space-saving lighting system, the light module of the lighting device and the lighting unit may be arranged relative to each other in such a manner that the light propagation direction of the collimator of the light module and the light-emitting direction of the lighting unit have an acute angle to each other.

Preferably, the light propagation direction of the collimator of the light module and the light-emitting direction of the lighting unit intersect, wherein the point of intersection is in the focal plane of the lenses of the collimator. In other words, the light module of the lighting device and the lighting unit are positioned relative to each other in such a manner that the light propagation direction and the light-emitting direction are each directed toward the light-coupling surface of the optical element.

When the optical element is in the first position, the at least one light module of the lighting device may be in an active state in which light is emitted onto the light-coupling surface by the at least one light module, wherein the lighting unit is in an inactive state in which it does not emit light while the lighting device is in the active state.

When the optical element is in the second position, the lighting unit may be in an active state in which light is emitted as a light beam by the lighting unit, wherein the at least one light module of the lighting device is in an inactive state in which the at least one light module does not emit light while the lighting unit is in the active state.

The lighting system may, in particular, generate a first light distribution when the optical element is in the first position and the at least one light module of the lighting device is in an active state, and generate a second light distribution when the optical element is in the second position and the lighting unit is in an active state, wherein preferably the first and the second light distribution are different. This results in the advantage that the lighting system can switch between different light distributions or lighting functions by means of adjusting the optical element without having to adjust or pivot a light module or the lighting unit.

Preferably, the first light distribution comprises a light distribution of a daytime running light or a signal light function, and the second light distribution a low-beam distribution or high-beam distribution. Advantageously, the light module of the lighting device can therefore be active, and the optical element can be in the first position when a daytime running light or a signal light function is required. However, if a low beam or a high beam is required, the light module of the lighting device can in particular be brought into an inactive state, wherein the lighting unit is brought into an active state, in particular essentially simultaneously, and furthermore the optical system is transposed from the first to the second position. This allows the transition between different light functions or light distributions to be carried out quickly and easily.

Preferably, the lighting device and/or the lighting unit each have a light source which is set up for generating white and/or coloured light. Thus, the lighting device can advantageously provide, for example, coloured light for a signal light function and the lighting unit can advantageously provide essentially white light for a low or high beam.

At this point, it should be mentioned that a person skilled in the field of automotive headlight technology has the necessary expertise with regard to the required control elements or control methods, which is why details of the mechanical and electrical control of the lighting device and the lighting system are not discussed in more detail.

For the purposes of this description, the terms "top", "bottom", "horizontal", and "vertical" shall be understood as indications of the orientation when the lighting device or lighting system is arranged in a normal position of use after it has been installed in a motor vehicle headlight.

The invention is further explained below on the basis of a preferred embodiment, to which it should not be limited, however. In the drawings.

Figure 1:
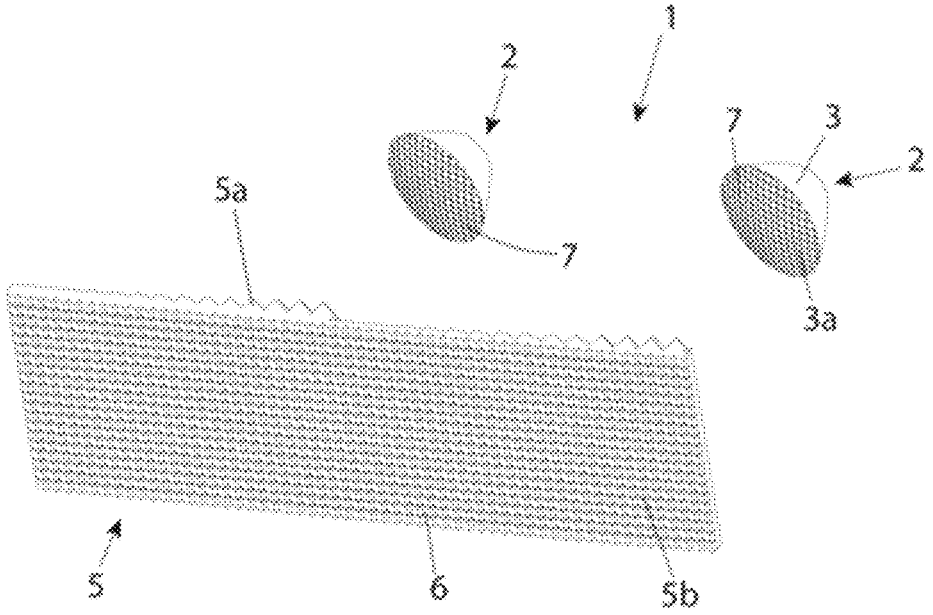
FIG. 1 is a perspective view of a lighting device according to the invention having two light modules.
Figure 4:
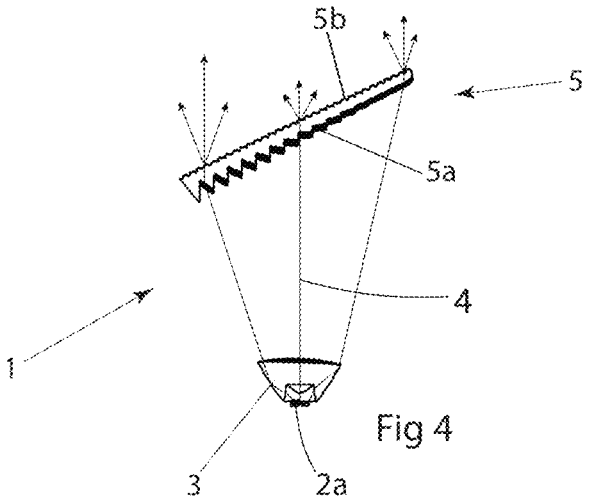
FIG. 4 is a top view of the lighting device with a light module with a schematic light beam progression.
Figure 4A:
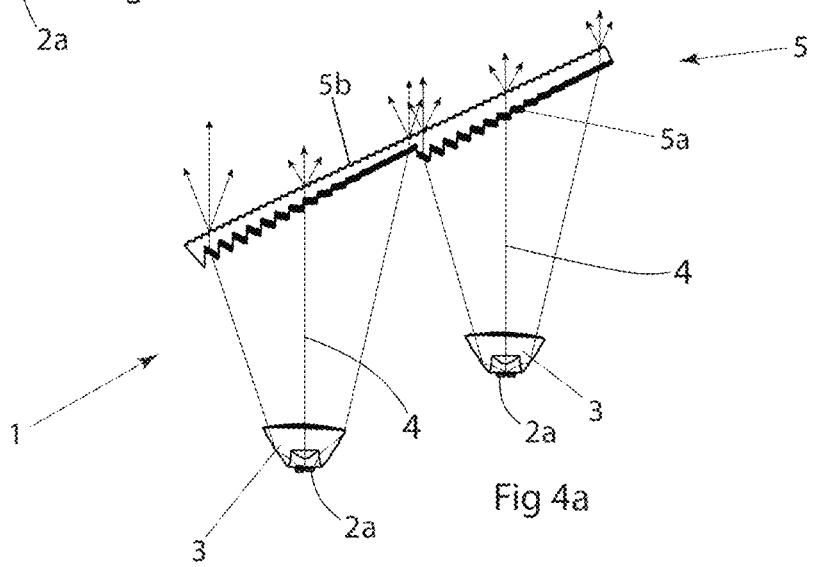
Figure 5:
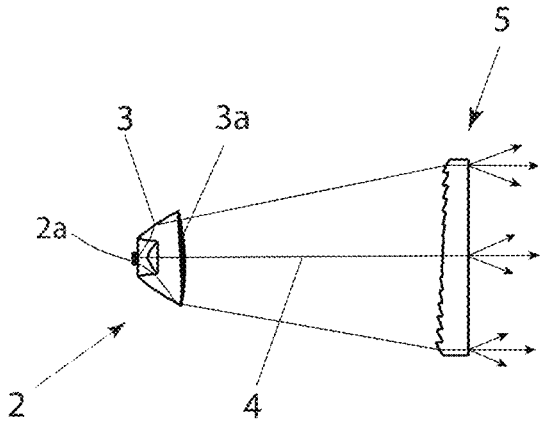
Figure 6:
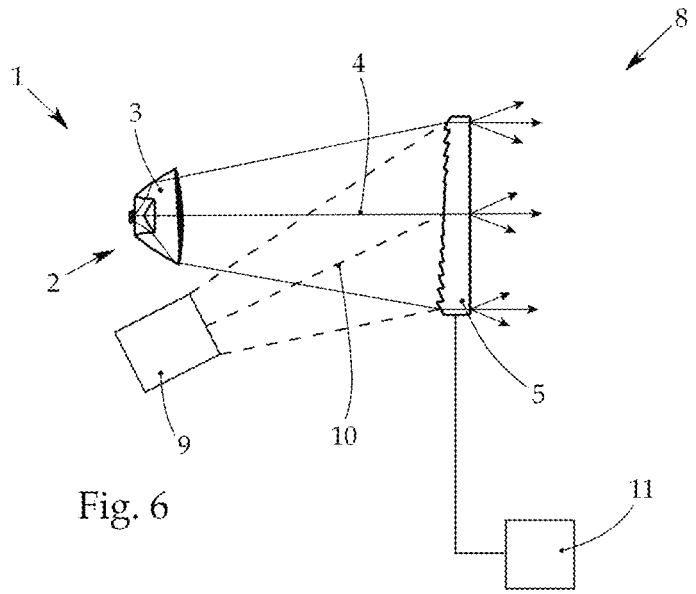
Figure 7:
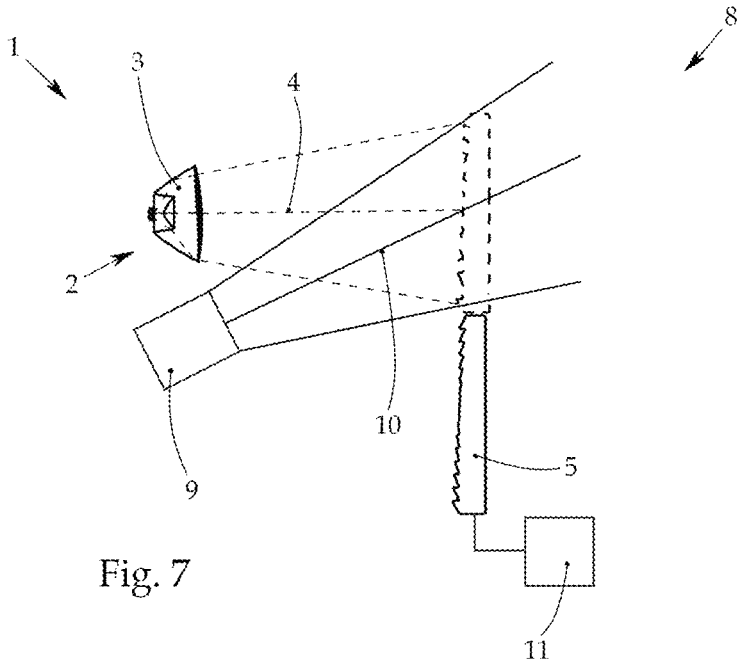

FIG. 4*a* is a top view of the lighting device according to FIG. 1 with a schematic light beam progression;

FIG. 5 is a side view of the lighting device with a schematic light beam progression;

FIG. 6 is a side view of the lighting system in a first operating state; and FIG. 7 is a side view of the lighting system in a second operating state.

The drawings are greatly simplified for a better overview and show only the essential components of the invention.

Figure 2:
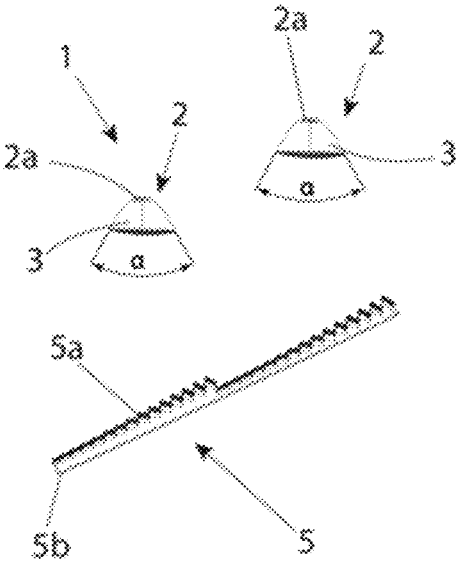
FIG. 2 is a top view of the lighting device according to FIG. 1.
Figure 3:
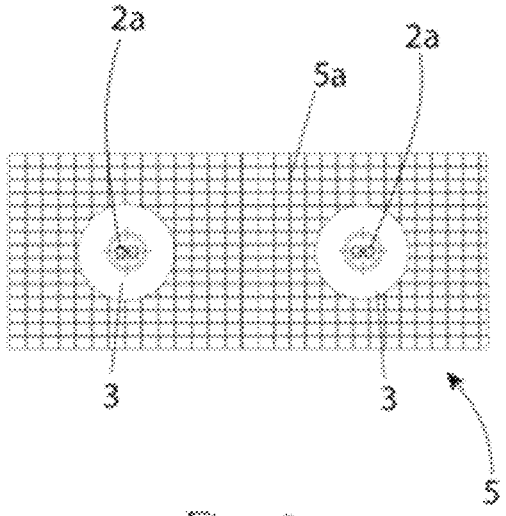
FIG. 3 is a back view of the lighting device according to FIG. 1.

FIG. 1-3 show different views of a lighting device 1 for a motor vehicle headlight having two light modules 2, wherein the light modules 2 each have a light source 2*a* and a collimator 3. The light modules 2 are preferably designed identically. An embodiment with one light module 2 is shown in FIG. 4. The collimator 3 is set up in such a manner that the light generated by the light source 2*a* is emitted as a divergent light beam in a light propagation direction 4 via a light-emitting surface 3*a* of the collimator 3 (see FIG. 4-5). In the embodiment shown here, the collimator 3 is conically shaped and has an opening angle $\alpha$ of 25° to 30° (see FIG. 2). The lighting device further comprises an optical element 5, which is arranged downstream of the collimator 3, as seen in the light propagation direction 4. The optical element 5 has a light-coupling surface 5*a* and a light-decoupling surface 5*b*, wherein the light from the collimator 3 strikes the light-coupling surface 5*a*, is directed to the light-decoupling surface 5*b* through the optical element 5 and is emitted from the optical element 5 at the light-decoupling surface 5*b*. The light-coupling surface 5*a* has a Fresnel optics, which is designed to refract the light beams as they enter the optical element 5 in such a manner that the light beams propagate parallel to each other within the optical element 5. The light-decoupling surface 5*b* of the optical element 5 has multiple optical elements 6, wherein each optical element 6 is designed and set up in such a manner that the light from each optical element 6 is emitted as a divergent light beam (see FIG. 4-5).

The light-emitting surface 3*a* of the collimator 3 is formed from multiple lenses 7. The lenses 7 are arranged in a uniform grid on the entire light-emitting surface 3 of the collimator 3. Each lens 7 is set up for radiating the light of the light source 2*a* divergently onto the light-coupling surface 5*a* of the optical element 5, such that each of the multiple lenses 7 illuminates the light-coupling surface 5*a* of the optical element 5. All lenses 7 have essentially the same focal length, with the distance between the collimator 3 and the optical element 5 essentially equal to the focal length of the lenses 7.

In the embodiment shown, the optical element 5 is designed flat or planar and plate-shaped, wherein the optical element 5 can also be designed as a curved plate. Each of the multiple lenses 7 completely illuminates the light-coupling surface 5*a* of the optical element 5. As a result, the illumination of the light-coupling surface 5*a* is composed of an overlap of the light emitted by all lenses 7. Each lens 7 has the same dimensions and/or optical properties. The diameter of each lens is 0.2 mm to 5 mm, preferably 0.6 mm to 3 mm, particularly preferably 1 mm to 2 mm.

As shown in FIG. 3, the light-emitting surface 3*a* of the collimator 3 is smaller than the light-coupling surface 5*a* of the optical element 5. The light-emitting surface 3*a* of the collimator 3 is spaced apart from the light-coupling surface 5*a* of the optical element 5, wherein the light emitted from each lens 7 exclusively illuminates the light-coupling surface 5*a* of the optical element 5 completely or exactly. In particular, no light beams extend laterally or beyond an edge of the optical element 5. The lenses 7 of the light-emitting surface 3*a* are thus calculated to the size of the light-coupling surface 5*a*.

In the embodiment according to FIG. 4, the collimator 3 illuminates the entire light-coupling surface 5*a*. In the embodiment according to FIG. 4*a*, the first light module 2 illuminates a first partial area of the light-coupling surface 5*a*, and the second light module 2 illuminates a second partial area of the light-coupling surface 5*a*, wherein, for example, the first and the second partial area each form one half of the light-coupling surface 5*a*. The first and second partial areas are preferably illuminated without overlapping.

FIG. 4-5 schematically represent the beam path of the light beams between the collimator 3 and the optical element 5 and downstream of the optical element 5, wherein only the two outer and one central light beam are shown. The Fresnel optics of the light-coupling surface 5*a* has a structure which compensates for the angle between the collimators 3 and the light-coupling surface 5*a*, such that all light beams within the optical element are aligned parallel.

FIG. 6 and FIG. 7 show a lighting system 8 having a lighting device 1 and a lighting unit 9. The lighting unit 9 is set up for generating light and radiating the same along a light-emitting direction 10. The light-emitting direction 10 is aligned toward the focal plane of the lenses 7 of the collimator 3 of the light module 2 or toward the optical element 5 when the latter is arranged in a first position (see FIG. 6). The lighting system 8 comprises an adjusting device 11, by means of which the optical element 5 can be transposed between the first and a second position. The second position is shown in FIG. 7. In the first position, the light emitted by the collimator 3 of the lighting device 1 strikes the light-coupling surface 5*a* of the optical element 5. The lighting unit 9 is inactive at this time and does not emit any light, which is indicated by the dashed lines. In the second position, the optical element is positioned outside the light propagation direction 4 of the collimator 3 and also outside the light-emitting direction 10 of the lighting unit 9. Thus, the light of the lighting unit 9 can be emitted unhindered, for example onto a roadway.

The light module 2 of the lighting device 1 and the lighting unit 9 are arranged relative to each other in such a manner that the light propagation direction 4 of the collimator 3 of the light module 2 and the light-emitting direction 10 of the lighting unit 9 have an acute angle to each other. The light propagation direction 4 and the light-emitting direction 10 intersect at a point which is positioned in the focal plane of the lenses 7 of the collimator 3.

When the optical element 5 is in the first position, the light module 2 of the lighting device 1 is in an active state in which light is emitted from the light module 2 to the light-coupling surface 5*a*. The lighting unit 9 at this time is in an inactive state, in which the lighting unit 9 does not emit any light.

When the optical element 5 is in the second position (see FIG. 7), the lighting unit 9 is in an active state in which light is emitted by the lighting unit 9 as a light beam. The light module 2 of the lighting device 1 at this time is in an inactive state, in which the light module 2 does not emit any light. This is indicated by the dashed lines in FIG. 7. The first position of the optical element 5 is also indicated in FIG. 7 as a dashed line.

The lighting system 8 may generate a first light distribution when the optical element 5 is in the first position and the at least one light module 2 of the lighting device 1 is in an active state. Furthermore, a second light distribution can be generated when the optical element 5 is in the second position and the lighting unit 9 is in an active state.

The first light distribution for example is a light distribution of a daytime running light or a signal light function, and the second light distribution is a low-beam distribution or high-beam distribution. Accordingly, it is possible to switch between different light distributions, depending on the position of the optical element 5.

The invention claimed is:

1. A lighting device (1) for a motor vehicle headlight, comprising:

at least one light module (2), wherein the light module (2) comprises a light source (2*a*) and a collimator (3) associated with the light source (2*a*), wherein the light source (2*a*) is configured to generate light and couple the light into the collimator (3), wherein the collimator (3) is configured to emit the light generated by the light source (2*a*) via a light-emitting surface (3*a*) of the collimator (3) as a divergent light beam in a light propagation direction (4); and an optical element (5) which is arranged downstream of the collimator (3), as seen in the light propagation direction (4), with a light-coupling surface (5*a*) and a light-decoupling surface (5*b*), wherein the light which is emitted from the collimator (3) strikes the light-coupling surface (5*a*) of the optical element (5), is directed through the optical element (5) to the light-decoupling surface (5*b*) of the optical element (5), and is emitted from the optical element (5) at the light-decoupling surface (5*b*), wherein the light-coupling surface (5*a*) of the optical element (5) has a Fresnel optics, wherein the Fresnel optics is configured to refract the light beams as they enter the optical element (5) in such a manner that the light beams propagate parallel to each other within the optical element (5), wherein the light-decoupling surface (5*b*) of the optical element (5) has multiple optical elements (6), wherein each optical element (6) is configured such that the light is emitted from each optical element (6) as a light beam, wherein the light-emitting surface (3*a*) of the collimator (3) is formed from multiple lenses (7), which are arranged in a uniform grid on the entire light-emitting surface (3*a*) of the collimator (3), wherein each lens (7) is set up for emitting the light of the light source (2*a*) toward the light-coupling surface (5*a*) of the optical element (5) in a divergent manner, such that each of the multiple lenses (7) illuminates the light-coupling surface (5*a*) of the optical element (5), wherein all lenses (7) have essentially the same focal length, wherein the collimator (3) and the optical element (5) are spaced apart from each other, wherein the distance between them essentially corresponds to the focal length of the lenses (7).

2. The lighting device (1) according to claim 1, wherein the optical element (5) is plate-shaped, wherein the plate-shaped optical element (5) is curved or flat.

3. The lighting device (1) according to claim 1, wherein each of the multiple lenses (7) illuminates the light-coupling surface (5*a*) of the optical element (5) completely, which means that the illumination of the light-coupling surface (5*a*) is composed of an overlap of the light emitted by all lenses (7).

4. The lighting device (1) according to claim 1, wherein each lens (7) has the same dimensions and/or optical properties.

5. The lighting device (1) according to claim 1, wherein the diameter of each lens is 0.2 mm to 5 mm.

6. The lighting device (1) according to claim 1, wherein the light-emitting surface (3*a*) of the collimator (3) is smaller than the light-coupling surface (5*a*) of the optical element (5).

7. The lighting device (1) according to claim 1, wherein the light-emitting surface (3*a*) of the collimator (3) is spaced apart from the light-coupling surface (5*a*) of the optical element (5) and arranged in such a manner that the light emitted from each lens (7) exclusively illuminates the light-coupling surface (5*a*) of the optical element (5) completely and exactly.

8. The lighting device (1) according to claim 1, having a first (2) and a second light module (2*a*), wherein the first light module (2) illuminates a first partial area of the light-coupling surface (5*a*), and the second light module (2*b*) illuminates a second partial area of the light-coupling surface (5*a*), wherein the first and the second partial area each form one half of the light-coupling surface (5*a*).

9. The lighting device (1) according to claim 8, wherein the first and the second partial surface are illuminated without overlap.

10. A lighting system (8) comprising:

a lighting device (1) according to claim 1; and a lighting unit (9), wherein the lighting unit (9) is configured to generate light and radiate the light along a light-emitting direction (10), wherein the light-emitting direction (10) is aligned toward the focal plane of the lenses (7) of the collimator (3) of the light module (2), wherein the lighting system (8) comprises an adjusting device (11) by means of which the optical element (5) of the lighting device (1) can be transposed between a first and a second position, wherein the optical element (5) in the first position is arranged in such a manner that the light emitted by the at least one light module (2) of the lighting device (1) strikes the light-coupling surface (5*a*) of the optical element (5), wherein the optical element (5) in the second position is arranged in such a manner that no light emitted by the at least one light module (2) of the lighting device (1) strikes the light-coupling surface (5*a*) of the optical element (5), and the optical element (5) is positioned outside the light-emitting direction (10) of the light emitted by the lighting unit (9).

11. The lighting system (8) according to claim 10, wherein the light module (2) of the lighting device (1) and the lighting unit (9) are arranged relative to each other in such a manner that the light propagation direction (4) of the collimator (3) of the light module (2) and the light-emitting direction (10) of the lighting unit (9) have an acute angle to each other.

12. The lighting system (8) according to claim 10, wherein the light propagation direction (4) of the collimator (3) of the light module (2) and the light-emitting direction (10) of the lighting unit (9) intersect, wherein the point of intersection is in the focal plane of the lenses (7) of the collimator (3).

13. The lighting system (8) according to claim 10, wherein, when the optical element (5) is in the first position, the at least one light module (2) of the lighting device (1) is in an active state in which light is emitted onto the light-coupling surface (5*a*) by the at least one light module (2), wherein the lighting unit (9) is in an inactive state in which it does not emit light while the lighting device (1) is in the active state.

14. The lighting system (8) according to claim 10, wherein, when the optical element (5) is in the second position, the lighting unit (9) is in an active state in which light is emitted as a light beam by the lighting unit (9), wherein the at least one light module (2) of the lighting device (1) is in an inactive state in which the at least one light module (2) does not emit light while the lighting unit (9) is in the active state.

15. The lighting system (8) according to claim 10, wherein the lighting system (8) generates a first light distribution when the optical element (5) is in the first position and the at least one light module (2) of the lighting device (1) is in an active state, and generates a second light distribution when the optical element (5) is in the second position and the lighting unit (9) is in an active state.

16. The lighting system (8) according to claim 15, wherein the first light distribution comprises a light distribution of a daytime running light or a signal light function, and the second light distribution comprises a low-beam distribution or high-beam distribution.

17. The lighting system (8) according to claim 10, wherein the lighting device (1) and/or the lighting unit (9) each have a light source which is configured to generate white and/or coloured light.

18. The lighting device (1) according to claim 1, wherein each optical element (6) is configured such that the light is emitted from each optical element (6) as a divergent light beam.

19. The lighting device (1) according to claim 5, wherein the diameter of each lens is from 0.6 mm to 3 mm.

20. The lighting device (1) according to claim 5, wherein the diameter of each lens is from 1 mm to 2 mm.

21. The lighting system (8) according to claim 15, wherein the first light distribution and the second light distribution are different from one another.

* * * * *